US006554104B2

(12) United States Patent
Ohyama et al.

(10) Patent No.: US 6,554,104 B2
(45) Date of Patent: Apr. 29, 2003

(54) LUBRICATION STRUCTURE FOR INTERNAL COMBUSTION ENGINE

(75) Inventors: Takashi Ohyama, Saitama (JP); Shinji Kuga, Saitama (JP); Ryuji Tsuchiya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 48 days.

(21) Appl. No.: 09/821,058

(22) Filed: Mar. 30, 2001

(65) Prior Publication Data

US 2001/0025742 A1 Oct. 4, 2001

(30) Foreign Application Priority Data

Mar. 31, 2000 (JP) ..... 2000-098861

(51) Int. Cl.[7] ..... F01M 11/00
(52) U.S. Cl. ..... 184/6.28; 123/196 R; 184/6.8
(58) Field of Search ..... 123/196 R; 184/6.28, 184/6.24, 6.5, 6.6, 6.7, 6.8, 6.9

(56) References Cited

U.S. PATENT DOCUMENTS

| | | | | |
|---|---|---|---|---|
| 3,557,767 A | * | 1/1971 | Green | 123/196 A |
| 4,538,565 A | * | 9/1985 | Hidaka et al. | 123/195 R |
| 5,078,106 A | * | 1/1992 | Matsuo et al. | 123/196 R |
| 5,842,451 A | | 12/1998 | von Eisebeck et al. | |
| 5,857,442 A | * | 1/1999 | Sumi | 123/196 CP |
| 6,887,565 | | 3/1999 | Ozeki et al. | |
| 5,901,791 A | * | 5/1999 | Ichikawa et al. | 172/125 |
| 6,024,193 A | * | 2/2000 | Fukushima | 123/196 A |
| 6,397,810 B2 | * | 6/2002 | Ohyama et al. | 123/192.2 |

FOREIGN PATENT DOCUMENTS

| | | |
|---|---|---|
| DE | 197 39 668 A1 | 3/1999 |
| EP | 0 610 617 A1 | 8/1994 |
| FR | 2 555 468 | 7/1975 |
| GB | 2 130 653 A | 6/1984 |
| JP | A988538 | 3/1997 |

* cited by examiner

*Primary Examiner*—Christopher P. Schwartz
*Assistant Examiner*—Devon Kramer
(74) *Attorney, Agent, or Firm*—Birch, Stewart, Kolasch & Birch, LLP

(57) ABSTRACT

A lubrication structure for an internal combustion engine including an oil pump provided at a first end of an oil pump shaft arranged parallel to a crankshaft. Oil passageways are formed from a side surface of a pump chamber of the oil pump to another end of the oil pump shaft in parallel with the oil pump shaft. An oil filter is provided facing towards the oil passageways. A communicating passageway extending vertically from the oil passageways to the oil filter is also provided. This arrangement provides a lubrication structure for an internal combustion engine with a high degree of freedom with respect to oil filter arrangement with a simple oil passageway that is easy to manufacture, requires relatively small space for arrangement, and thus makes it possible to reduce the size of the internal combustion engine.

18 Claims, 8 Drawing Sheets

LUBRICATION STRUCTURE FOR INTERNAL COMBUSTION ENGINE

BACKGROUND OF THE INVENTION

1. Field of the Invention

The present invention relates to a lubrication structure for an internal combustion engine, and more particularly to a lubrication structure permitting optimum arrangement of lubrication system components and size reduction of an internal combustion engine for a vehicle.

2. Background Art

Generally, a lubrication system for an internal combustion engine guides oil from a pump chamber arranged near an inner side of the internal combustion engine to the oil filter arranged near the outer side of the internal combustion engine. An example of a similar arrangement is shown in Japanese Patent Laid-open Publication No. Hei. 9-88538.

FIG. 8 is a cross-sectional view of a section of an internal combustion engine taken in the vicinity of an oil pump shaft as found in the conventional art. A clutch cover 02' is joined to a right surface of a right crankcase 01'. An oil pump shaft 04' is pivotally supported between the right crankcase 01' and the clutch cover 02' oriented in a lateral direction parallel to a crankshaft 03'.

An oil pump 05' is provided at an end of this oil pump shaft 04' at the right crankcase 01' side, and is connected to an oil filter 06' provided in a manner projecting from the clutch cover 02' by an oil passageway 07'.

The main oil passageway 07' is formed having an oil passageway 7*c*' passing an oil passageway way 07*b*' curving upwards from an oil passageway 07*a*' extending to the left from the side surface of the pump chamber of the oil pump at the right crank case 01' side. The main oil passageway 07' curves vertically and extends in a lateral direction, the oil passageway 07*c*' communicating with an oil passageway 07*d*' on the clutch cover 02' side. At the end of the oil passageway 07*d*' one branch passageway 07*e*' branches upwards to an oil filter 6', and another branch passageway 07*f*' is connected to an oil relief valve arranged between an oil pump shaft 04' and the oil passageway 07*d*'.

Since the oil filter 06' is provided on the clutch cover 02' at the outside of the internal combustion engine, the degree of freedom of arrangement of the oil filter 06' is low, and oil passageways 07*a*', 07*b*', 07*c*' guiding oil from the oil pump 05' provided at the right crank case 01' inside the internal combustion engine to the oil filter 06' detour in an open-ended square shape, making the passageway complicated and difficult to manufacture.

As the oil passageways 07*a*', 07*b*', 07*c*', 07*d*' form an open-ended square while detouring around the oil relief valve 08', a wide space is required to arrange the oil distribution route. Furthermore, this causes the oil filter 06' to be arranged in a further extended condition. These conditions make it further difficult to reduce the size of the internal combustion engine.

SUMMARY OF THE INVENTION

The present invention overcomes the shortcomings associated with the related art and achieves other advantages not realized by the related art.

An aspect of the present invention is to provide a lubrication structure for an internal combustion engine that permits a reduction in size of the internal combustion engine.

An additional aspect of the present invention is to provide a high degree of freedom with respect to oil filter arrangement that benefits from a simple oil passageway that is easy to process and requires relatively small spaces for arrangement.

These and other aspects of the present invention are accomplished by a lubrication structure for an internal combustion engine comprising an oil pump provided at a first end of an oil pump shaft, the oil pump shaft arranged in parallel with a crankshaft; a plurality of oil passageways extending from a side surface of a pump chamber of the oil pump to a second end of the oil pump shaft, the oil passageways arranged in parallel with the oil pump shaft; an oil filter positioned facing towards the oil passageways; and an oil communicating passageway extending vertically from a first oil passageway to the oil filter.

These and other aspects of the present invention are accomplished by a lubrication structure for an internal combustion engine, the internal combustion engine including a crankcase divided into a left crankcase and a right crankcase along a longitudinal centerline, and having a crankshaft arranged transversely therein, the lubrication structure comprising an oil pump having a pump chamber provided at a first end of an oil pump shaft, the oil pump shaft arranged in parallel with the crankshaft; a plurality of oil passageways extending from a side surface of the pump chamber of the oil pump to a second end of the oil pump shaft, the oil passageways arranged in parallel with the oil pump shaft; an oil filter positioned facing towards the oil passageways; an oil introduction passageway extending vertically from a first oil passageway to the oil filter; and an oil discharge port forming an oil supply passageway from an oil pan positioned in a lower portion of the crankcase.

With this simple oil passageway arrangement having an oil passageway formed from a side surface of the pump chamber of the oil pump to another end of the oil pump shaft parallel to the oil pump shaft, and a communicating passageway extending to the oil filter towards the oil passageway vertically without bypassing the oil passageway, the lubrication system is easy to manufacture, the space for arrangement can be reduced, and the protrusion of the oil filter from the internal combustion engine can be suppressed. Therefore the size of the internal combustion engine can be reduced.

As it is capable of extending the communicating passageway vertically from any position of the oil passageway to connect to the oil filter, the degree of freedom of oil filter arrangement is increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not intended to limit the present invention to the embodiments shown, and wherein.

DETAILED DESCRIPTION OF THE PREFERRED EMBODIMENTS

Figure 1:
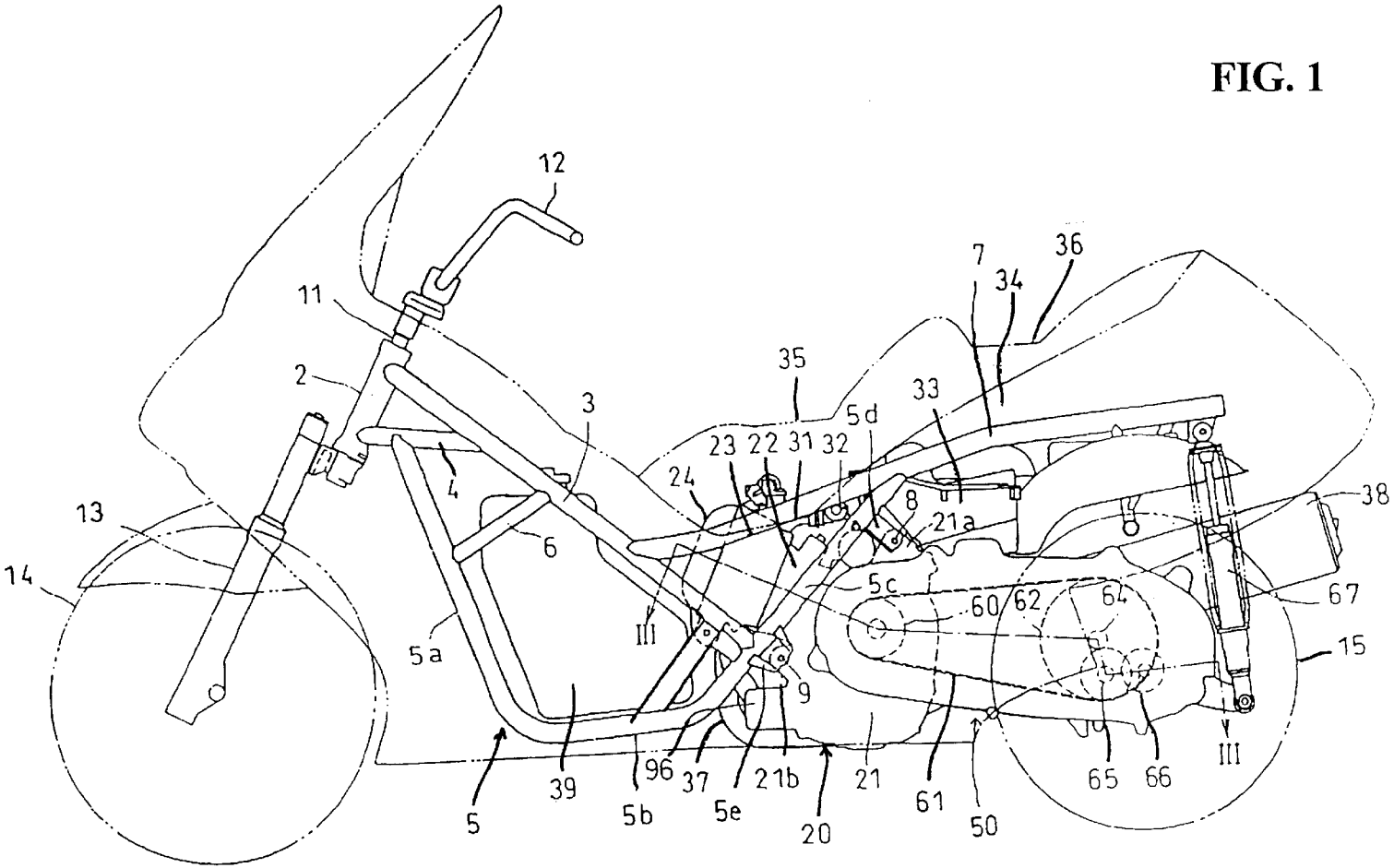
FIG. 1 is a side view of a vehicle having an internal combustion engine according to an embodiment of the present invention.
Figure 2:
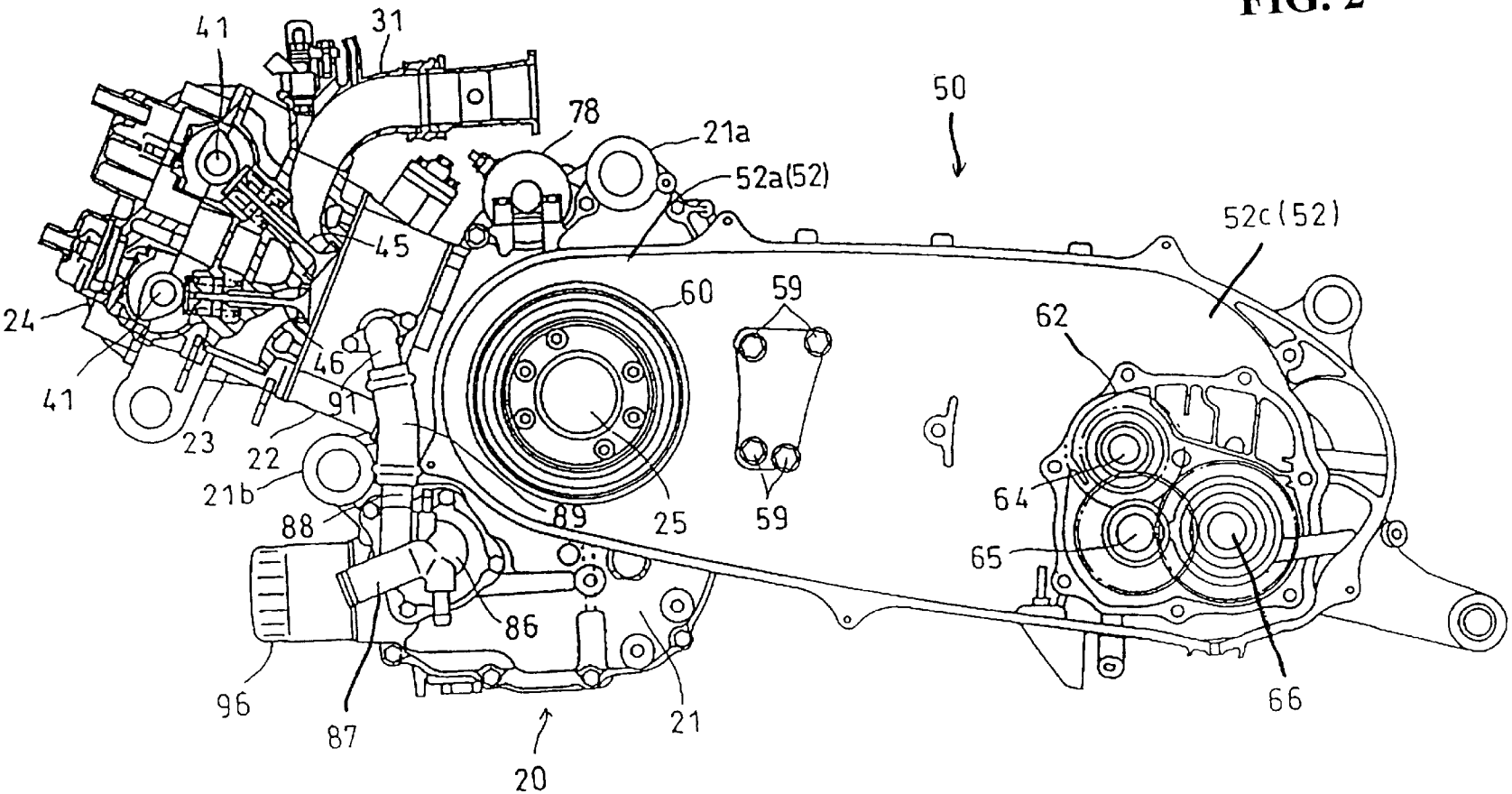
FIG. 2 is a cross-sectional side view of an internal combustion engine and belt-type automatic transmission according to an embodiment of the present invention.
Figure 3:
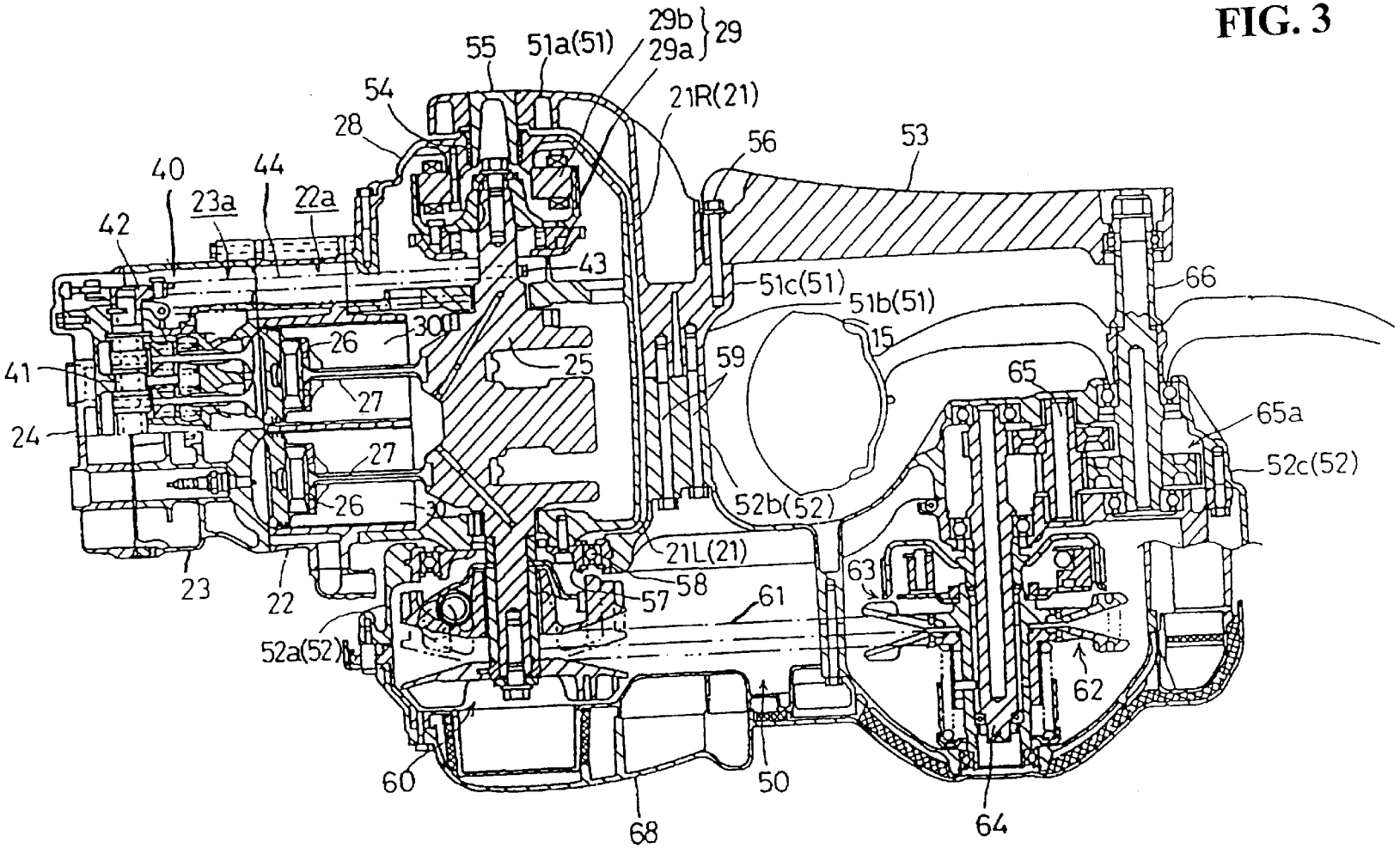
FIG. 3 is a cross-sectional view taken along line III—III of FIG. 1.
Figure 4:
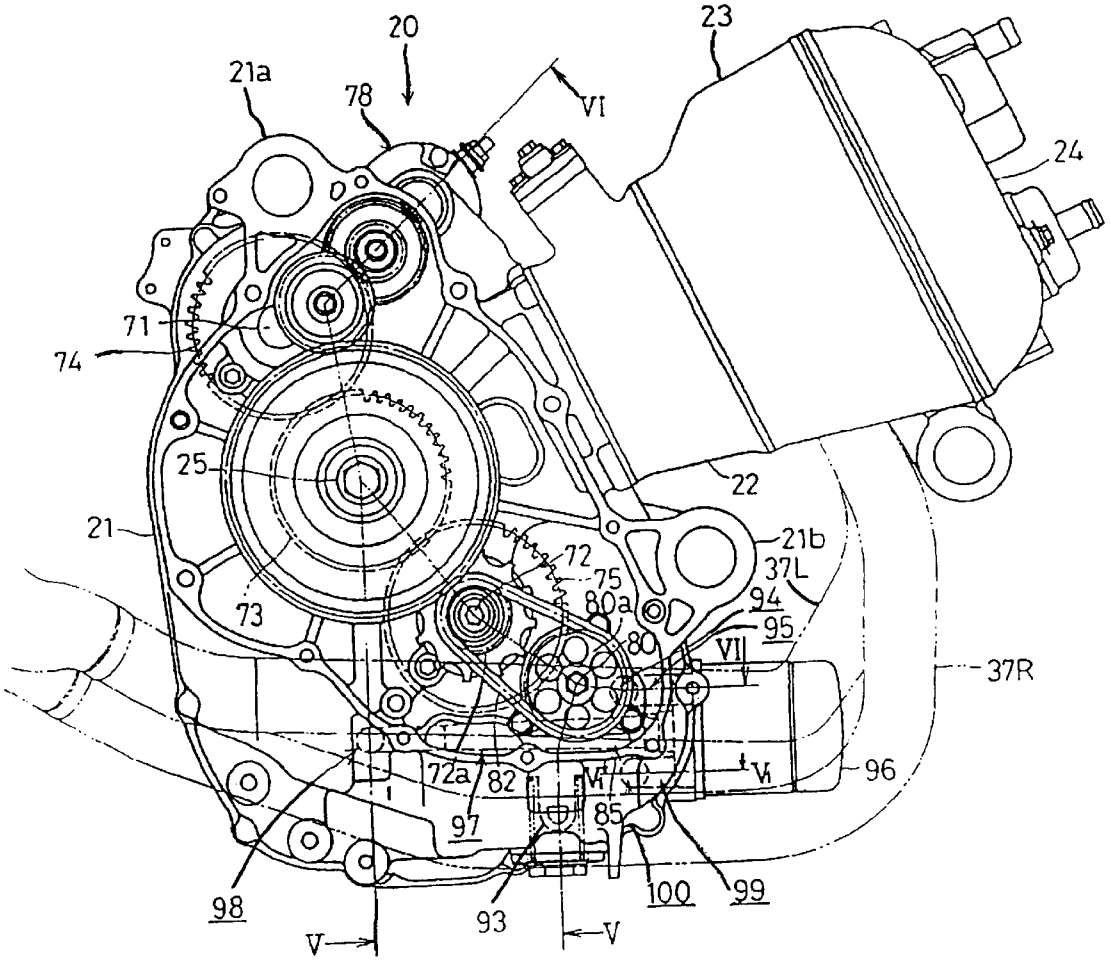
FIG. 4 is a right side view of an internal combustion engine having a case cover removed according to an embodiment of the present invention.
Figure 5:
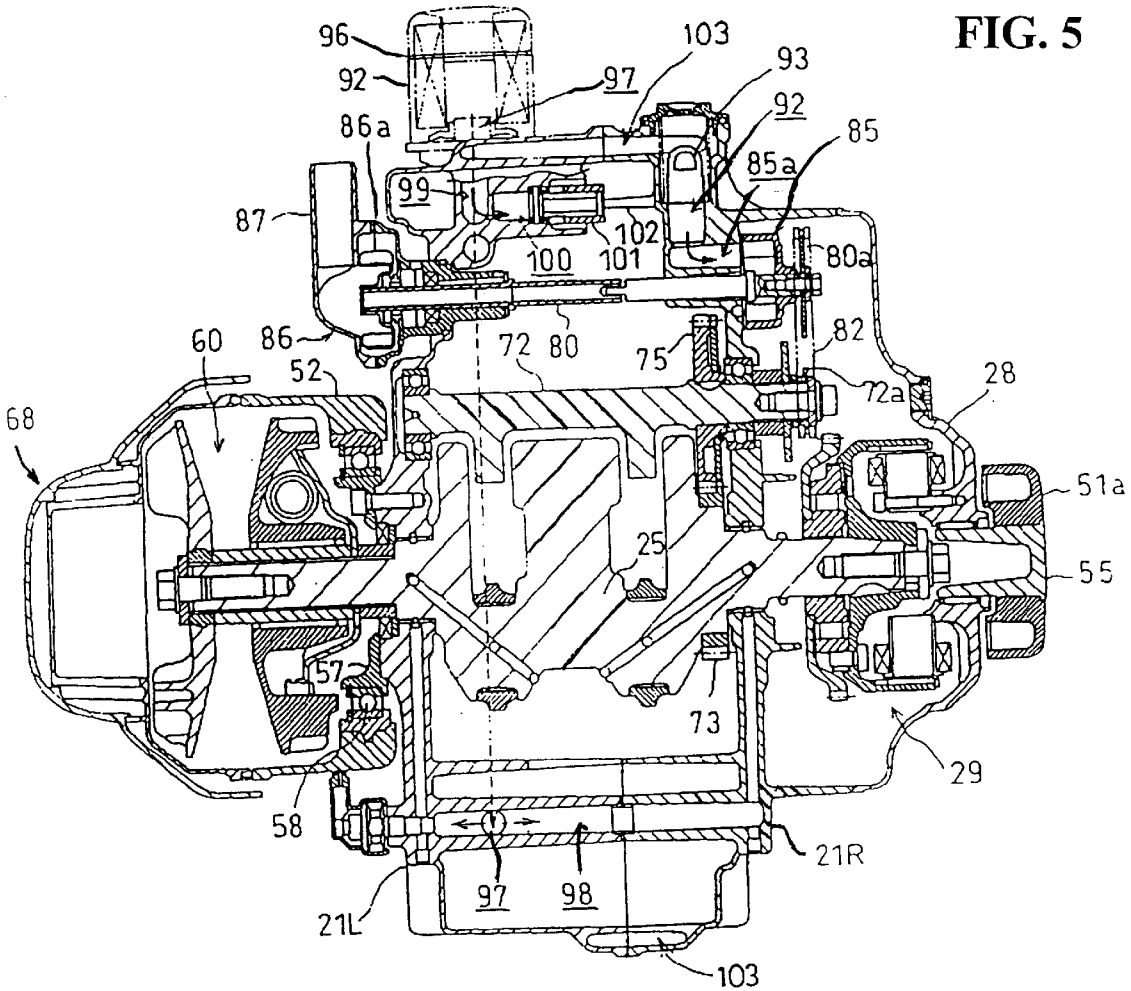
FIG. 5 is a cross-sectional view taken along line V—V and line V1—V1 of FIG. 4.
Figure 6:
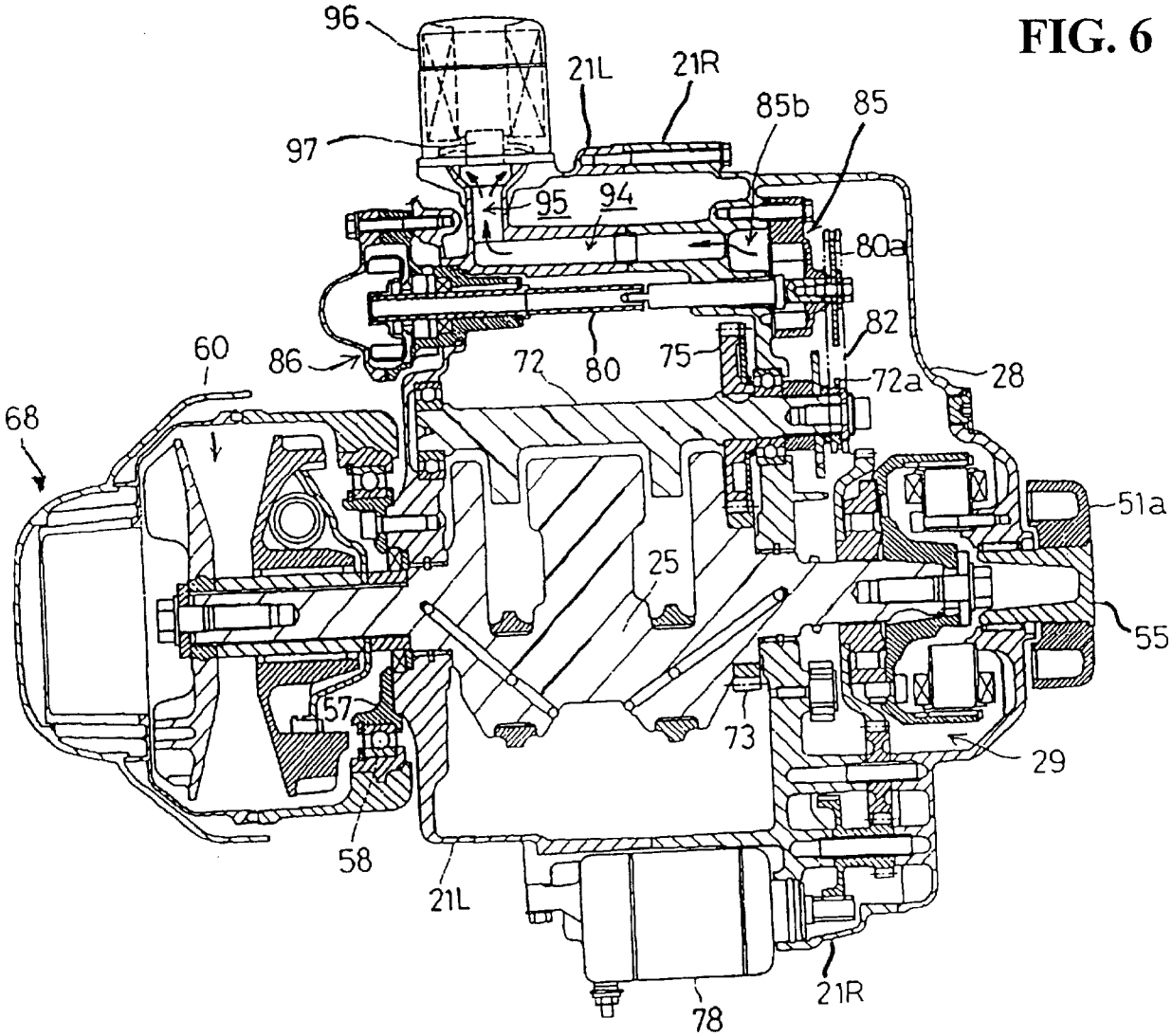
FIG. 6 is a cross-sectional view taken along line VI—VI of FIG. 4.
Figure 7:
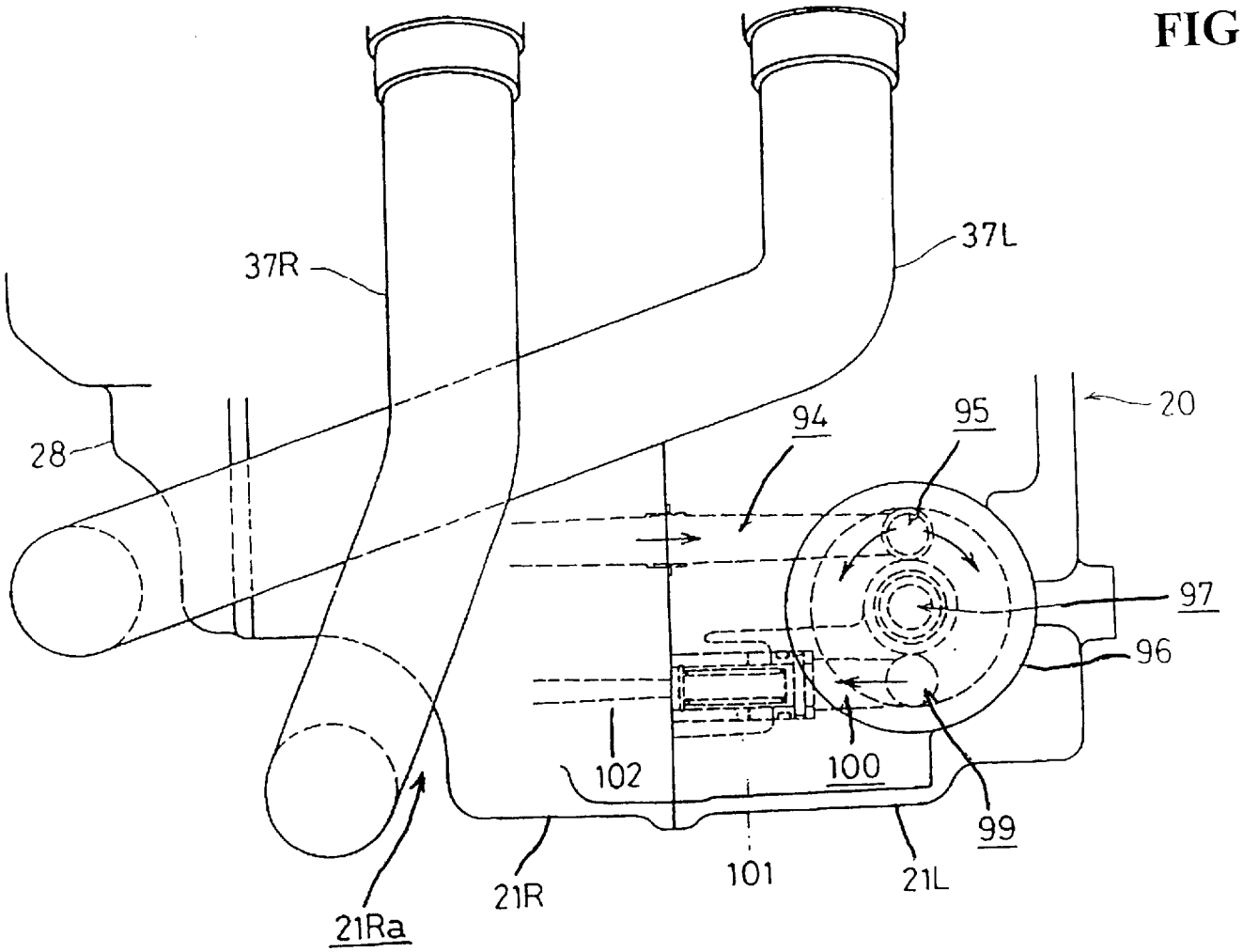
FIG. 7 is a frontal view of lower parts of the internal combustion engine.
Figure 8:
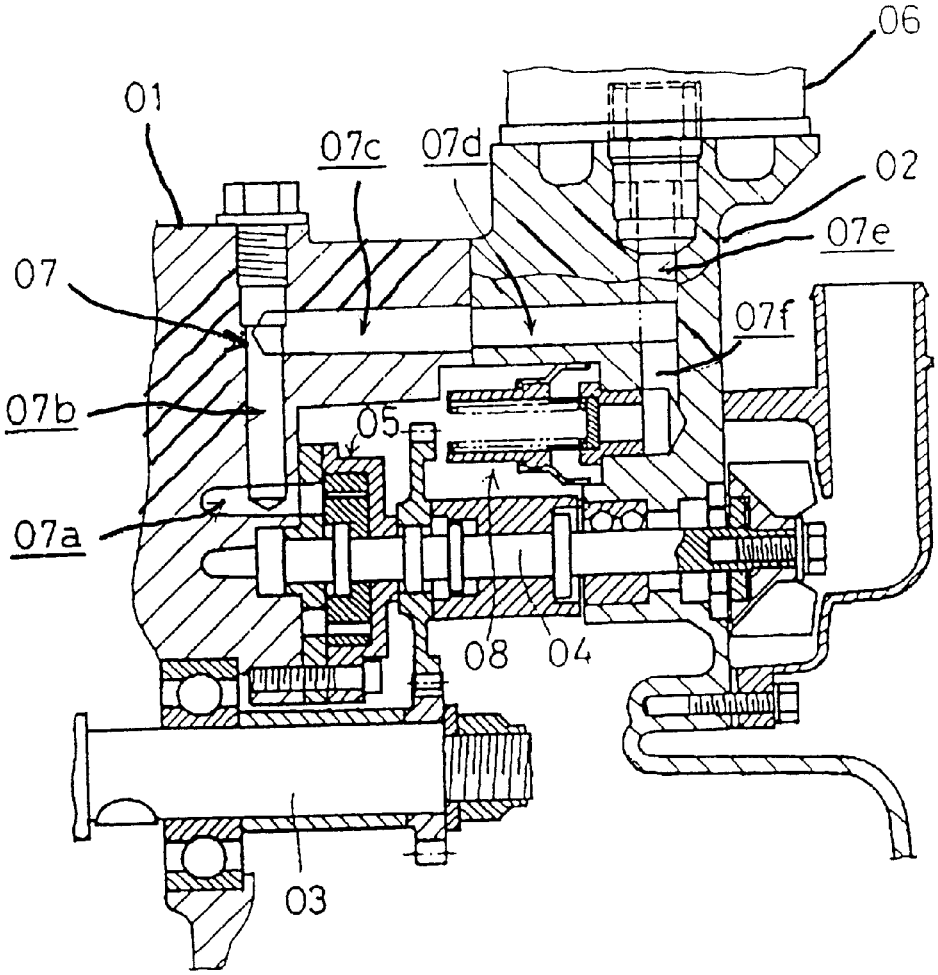
FIG. 8 BACKGROUND ART
FIG. 8 is a cross-sectional view of a section of an internal combustion engine taken in the vicinity of an oil pump shaft as found in the conventional art.

Hereinafter, the present invention will be described in detail with reference to the accompanying drawings. The present invention will now be described with reference to FIG. 1 to FIG. 7. FIG. 1 is a side view of a vehicle having an internal combustion engine according to an embodiment of the present invention. FIG. 2 is a cross-sectional side view of an internal combustion engine and belt-type automatic transmission according to an embodiment of the present invention. FIG. 3 is a cross-sectional view taken along line III—III of FIG. 1. FIG. 4 is a right side view of an internal combustion engine having a case cover removed according to an embodiment of the present invention. FIG. 5 is a cross-sectional view taken along line V—V and line V1—V1 of FIG. 4. FIG. 6 is a cross-sectional view taken along line VI—VI of FIG. 4. FIG. 7 is a frontal view of lower parts of the internal combustion engine.

An internal combustion engine in a preferred embodiment is applied to a scooter-type motorcycle. A side view of a scooter-type motorcycle is shown in FIG. 1.

In the vehicle frame of the scooter-type motorcycle 1, a pair of left and right main pipes 3, 3 extend from an upper part of head pipe 2 diagonally downwards and rearward, and in a straight line when viewed from the side. A pair of support pipes 4, 4 extending substantially horizontal from the head pipe 2 are connected to the main pipes 3, 3, and support front parts of the main pipes 3, 3.

From the middle part of the support pipe 4, 4, a pair of down pipes 5, 5 extend laterally and steeply diagonally downwards to form front side vertical sections 5*a*, 5*a*. The down pipes 5, 5 then each bend rearward at a lower end to form central horizontal sections 5*b*, 5*b*, and bend upwards at the rear end to form rear side sloping sections 5*c*, 5*c*.

The rear ends of the main pipes 3,3 are connected to lower parts of the rear side sloping sections 5*c*, 5*c*, and a reinforcing pipe 6 is interposed between the main pipe 3 and the down pipe 5, forming a substantially triangular shape in side view.

Seat rails 7, 7, the front ends of which are fixed to sections slightly rearward from the center of the main pipes 3, 3, extend slightly diagonally upwards, nearly horizontal, and rearwards to the rear part of the vehicle body. Upper ends of the rear side sloping sections 5*c*, 5*c* of the down pipes 5,5 are connected to the center parts of the seat rails 7, 7, and support the seat rails 7,7 from underneath.

A head pipe 2 pivotally supports a steering shaft 11. Handlebars 12,12 are formed spreading out laterally above the head pipe 2. A front fork 13 extends underneath, and a front wheel is pivotally supported at the lower end thereof.

At the upper part and lower part of the rear side sloping section 5*c* of the down pipe 5, support brackets 5*d* and 5*e* are provided protruding rearwards. The internal combustion engine 20 is suspended from a respective pair of support brackets 5*d* and 5*e* on both the left side and right side of the vehicle.

The internal combustion engine 20 is a four cycle, two-cylinder internal combustion engine having a crankcase 21 arranged rearward of the rear side sloping section 5*c* of the down pipe 5, and a cylinder block 22, cylinder head 23, and cylinder head cover 24 sequentially stacked together with a crankcase 21. The cylinder block 22, cylinder head 23, and cylinder head cover 24 are provided in a position forward of the rear side sloping section 5*c* and tilting significantly to the front.

The cylinder block 22, cylinder head 23, and cylinder head cover 24 are arranged in the triangular shape formed by the rear side sloping section 5*c*, the rear part of the main pipe 3, and the front part of the seat rail 7 on both the left side and right side when viewed from a side of the vehicle. Each of the mounting brackets 21 a provided at the upper part, and the mounting bracket 21*b* provided at the front part of the crankcase 21 in a protruding state are supported by the support brackets 5*d*, 5*e* via support shafts 8 and 9. Accordingly, the internal combustion engine 20 is suspended from the vehicle frame.

The front part of a belt-type automatic transmission 50 is mounted on the crankcase 21 of the internal combustion engine 20. The transmission 50 extends rearwards and pivotally supports a rear wheel 15 at a rear portion thereof.

Intake pipes 31, 31, extending upwards from each cylinder of the cylinder head 23 at a forward-bending position of the internal combustion engine, are curved rearwards and are connected to carburetors 32, 32 provided parallel to each other on the crankcase 21. Further, the carburetors 32, 32 are connected to an air cleaner 33 provided rear of the carburetors.

The air cleaner 33 is provided between the seat rails 7, 7 on left side and right side. A helmet storage box 34 is suspended and supported by the seat rails 7, 7 in a position above the air cleaner 33.

A driver's seat is provided that is capable of opening and closing covers over the internal combustion engine 20 and carburetor 32. A pillion seat 36 is also provided that is capable of opening and closing covers over the helmet storage box 34 and the rear part.

The exhaust pipes 37, 37, each extend downwards from the cylinder head 23, and extend in front of the crankcase 21 along its right side to the rear. The exhaust pipes combine into a single pipe at a position to the rear of the crankcase. The single exhaust pipe then extends diagonally upwards on the right side of the vehicle body and is connected to the muffler 38 supported at the right side of the rear wheel 15.

A fuel tank 39 surrounded by four pipes, namely two left and right main pipes 3,3 above and two left and right down pipes 5,5 in front and below, is suspended and supported in front of the internal combustion engine 20.

The configuration of a scooter-type motorcycle 1 according to a preferred embodiment is as described hereinabove. The structure of the internal combustion engine 20 and the belt-type automatic transmission mounted on a crankcase 21 will now be described hereinafter.

The divided crankcase 21 includes a combination of left and right crankcases 21L, 21R, respectively. As shown in FIG. 3, an outer rotor 29*a* of the AC generator 29 is attached to the right end of the crankshaft 25 oriented horizontally in a lateral direction in the crankcase 21. A case cover 28 is fixed to the right crankcase 21R and covers the side. An inner stator 29*b* of the AC generator 29 is supported by the case cover 28.

Pistons 26, 26 each reciprocate inside the 2 cylinder sleeves 30 of the cylinder block 22. The pistons 26 are connected to the crank pins of the crankshaft 25 via connecting rods 27,27. Both of the crank pins have a phase angle of 360 degrees.

A valve gear mechanism 40 is provided on the cylinder head 23. A timing chain 44 is suspended between cam chain sprockets 42, 42 fitted to the right ends of the upper and lower cam shafts 41, 41 oriented horizontally in a lateral direction. A drive chain sprocket 43 is fitted to the base part of crankshaft 25 protruding from the right crankcase 21R, to transmit the driving power.

The timing chain 44 passes through the cam chain chambers 22*a*, 23*a* arranged on the right side of the cylinder block 22 and the cylinder head 23. Cam shafts 41,41 drive the intake valve 45 and exhaust valve 46 at the prescribed timing.

The belt-type automatic transmission 50 is mounted on the crankcase 21 of the internal combustion engine 20.

A case cover 28, blocking off the right opening of the right crankcase 21R and covering the AC generator 29, has an opening coaxial with the crankshaft 25. A rotating shaft 55 is provided to the right in the opening via a bearing 54 so as to protrude from the right side of the crankcase 21R. The base end section 51*a* of the right side transmission case 51 of the belt-type automatic transmission case 50 is also fitted into this protruding section.

The right side transmission case 51 has a connection section 51*b* which runs from the base end section 51*a* circling around along the rear surface of the right crankcase 21R and to an inner side.

A mounting boss section 51*c* protrudes rearwards from respective upper and lower positions on the rear surface of the connection section 51*b*. A left side joining surface of the front end of the right fork member 53 is joined to the right side joining surface of the mounting boss section 51*c*, and the two upper and lower positions are screwed together with the bolt 56 to integrally connect the right fork member 53 to the right side transmission case 51, and extend rearward.

The left end of the crankshaft 25 protrudes leftward piercing through the left crankcase 21L. A drive pulley 60 with a centrifugal transmission mechanism is provided at the protruding section.

An annular support member 57 is fixed around the crankshaft 25 on the outer surface pierced by the crankshaft 25 of the left side crankcase 21L. A base end section 52*a* of the left side transmission case 52 is swingably supported by the annular support member 57 via a bearing 58.

The left side transmission case 52 has a connection section 52*b*, which runs from the base end section 52*a* circling around along the rear surface of the left crankcase 21L and into the inner side. A left fork section 52*c* extends further rearward.

The connection section 51*b* of the right side transmission case 51 circling clockwise along the rear surface of the crankcase 21, and the connection section 52*b* of the left side transmission case 52 circling counterclockwise along the rear surface of the crankcase 21, are joined to each other on their connection joining surfaces. The left and right side transmission cases 51,52 are screwed to each other with bolts 59 (four bolts 59 in a preferred embodiment), and the left fork member 52*c* and right fork member 53 face each other and are integrally connected.

The connected right side transmission case 51 is swingably supported by the bearing 54 on the crankshaft 25, and the left side transmission case 52 is swingably supported by a bearing 58 on the crankshaft 25. Therefore the left fork member 52*c* and right fork member 53 facing each other are integrally supported swingably up and down on the crankshaft 25.

A rear section of the left fork member 52*c* of the left side transmission case 52 includes a transmission chamber. A driven shaft 64 is rotatably supported, and the driven pulley 62 is pivotally supported on the driven shaft 64 via a central clutch 63. A V-belt 61 is suspended between the driven pulley 62 and the drive pulley 60 and constitutes a belt-type automatic transmission mechanism.

In the transmission chamber at the rear section of the left fork member 52*c*, a reduction gear includes a set of transmission gears 65*a*, in which drive force is transmitted from a driven shaft 64 to an axle 66 via an intermediate shaft 65.

The axle 66 is rotatably suspended between the left fork section 52*c* and the right fork member 53. The rear wheel 15 is supported by the axle 66 between the left fork section 52*c* and the right fork member 53.

As a result, the left and right side transmission cases 51 and 52 supporting the belt-type automatic transmission pivotally support the crankshaft 25 with the left fork section 52*c*, right fork member 53 and the rear wheel 15 swingable/pivotable up and down.

The center of the swingable rear wheel 15 is set coaxially with the crankshaft 25. Therefore, the length between the internal combustion engine 20 and the rear wheel 15 in a longitudinal direction can be shortened, and the overall length of the vehicle in the longitudinal direction can be shortened.

A rear cushion 67 is interposed between the rear end of the left side transmission case 52 and the rear end of the seat rail 7.

A belt cover 68 blocks off the left side opening of the left side transmission case 52 which stores the belt-type automatic transmission 50, and covers the belt-type automatic transmission from its left side.

The internal combustion engine 20 has a pair of balancer shafts 71 and 72 above and below the crankshaft 25. The balancer driven gears 74 and 75, each being respectively attached to each of the balancer shafts 71 and 72, mesh with the drive gear 73 fitted to the crankshaft 26 along the inner side surface of the bearing section of the right crankcase 21R at the same time. The rotation of the crankshaft 25 makes the two balancer shafts 71, 72 rotate in opposite directions.

Above the upper side balancer shaft 71, a mounting bracket 21*a* is mounted on the crankcase 21 so as to protrude therefrom. The starter motor 78 is arranged in front of the mounting bracket 21*a*. The starter motor 78, mounting bracket 21*a* and the upper side balancer shaft 71, are arranged centrally (refer to FIG. 4).

A pump drive shaft 80 is horizontally suspended diagonally forward under the lower side balancer shaft 72. A chain 82 is suspended between the drive sprocket 72, which is fitted to the right end of the lower side balancer shaft 72 protruding from the right crankcase 21R, and the driven sprocket 80*a*, which is fitted to the right end of the pump drive shaft 80 (refer to the FIG. 4 and FIG. 5).

Accordingly, the rotation of the crankshaft 25 causes rotation of the pump drive shaft 80 via the balancer shaft 72.

The two ends of the pump drive shaft 80 are arranged at an outer position of the two crank weight sections of the crankshaft 25. The oil pump 85 is provided between the right crankcase 21R of the pump drive shaft 80 and the driven sprocket 81 at the right end. The water pump 86 is provided at the part of the pump drive shaft 80 protruding from the left crankcase 21L.

As shown in FIG. 5, an intake connection pipe 87 protrudes forward from the left space in the center of the impeller 86*a* of the water pump 86. An exhaust connection pipe 88 protrudes upwards from the side of the impeller 86*a*. The exhaust connection pipe 88 and the connection pipe 91, which is provided at the cooling water inlet provided on the left side surface of the cylinder block 22 in a protruding state, are connected together with a hose 89 (refer to the FIG. 2).

An oil intake passageway toward the oil pan at the lower part of the crankcase 21 is formed at the intake port 85*a*, which is provided on the left surface of the pump chamber of the oil pump. An oil strainer 93 is interposed at the mid-point of the oil intake passageway 92 (refer to the FIG. 5).

As shown in FIG. 6, the oil passageway 94 is formed parallel to the pump shaft 80 to the left of the exhaust port 85*b* which is provided separately from the intake port 85*a* on the left side surface of the pump chamber of the oil pump 85 and from the right crankcase 21R to the left crankcase 21L in front of the water pump 86.

An oil introduction path 95, which bends forward vertically at the left end of the oil passageway 94, is a connection passageway for introducing oil into the oil filter 96 provided protruding forward from the lower part of the front wall of the left crankcase 21L.

The oil discharge path 97 extends rearward from the center of the jointing surface on the rear surface of the oil filter 96. The oil introduction path 95 is arranged above the oil discharge path 97 in the center (refer to FIG. 4 and FIG. 7).

The oil discharge path 97 extends straight rearward to the vicinity of the lower side of the crankshaft, and is connected to the oil supply path 98 which supplies oil to the various bearing sections, etc. of the internal combustion engine 20.

A relief communication passageway 99 protrudes rearward from the lower side of the oil discharge path 97 in the center of the rear surface of the oil filter 96 to the lower side of the oil passageway 94 (refer to FIG. 4 and FIG. 7), and bends rightward horizontally at the rear end. A relief passageway 100 parallel to the oil passageway 94 is formed therein.

The oil passageway 94 and the relief passageway 100 are formed at the upper and lower position of the oil discharge path 97 parallel to each other, and can be arranged while reducing the width in the longitudinal direction, which contributes to the reduction of the length of the internal combustion engine 20 in the longitudinal direction.

FIG. 5 shows a cross-sectional view along line V—V and line V1—V1 of FIG. 4. The right end of the relief passageway 100, which is arranged at the left crankcase while referring to the cross-section cut along the line V1—V1, is opened in the vicinity of the joining surface against the right crankcase 21R. A relief valve 101 is arranged fitted to the opening from its right side, and is attached coaxially to the relief passageway 100.

A protuberance 102, which holds the relief valve 101 from its right side, protrudes from the right crankcase 21R.

The configuration of the oil lubrication structure is as described above. When the oil pump 85 is driven by the rotation of the pump shaft 80, the oil pump 85 takes in the oil accumulated in the oil pan 103 at the lower part of the crankcase 21 via the oil strainer 93, and discharges the oil to the discharge port 85*b*.

The oil discharged to the discharge port 85*b* flows leftwards in the oil passageway 94, and enters the oil filter 96 via the oil introduction path 95.

The oil enters the outer side of the filter element of the oil filter 96, gets filtered and enters the inner side. Oil in the inner side of the filter 96 then flows out rearward via the oil discharge path 97, and is then supplied to the various bearing sections, etc. of the internal combustion engine 20 via the oil supply path 98.

The outer side of the filter element of the oil filter 96 is connected to the relief passageway 100 via the relief communicating passageway 99. When the fluid pressure at the outer side of the filter element becomes higher than a prescribed value due to the filter element being blocked/clogged, the relief valve 101 provided at the relief passageway 100 opens and discharges the oil to the crankcase 21.

The oil passageway 94 is arranged from the discharge port 85*b* on the side surface of the oil chamber of the oil pump 85 at the right end of the oil pump shaft 80 toward the left end parallel to the oil pump shaft 80. The oil introduction path 95 extends vertically without bypassing the oil passageway 94, and forms a simple oil passageway reaching the oil filter 96. The crankcase 21 is divided into a left part and a right part. Therefore, the oil passageway can be manufactured easily.

Also, the relief passageway 100 arranged at the left crankcase 21L extends rightward horizontally, and has an opening for attaching the relief valve 101 in the vicinity of the dividing surface. Therefore this relief passageway 100 can also be manufactured easily The oil passageway 94 is in the vicinity of the pump shaft 80. Therefore the oil introduction path 95 can be shortened, and the size of the space required for passageway arrangement can be reduced.

As a result, the position for mounting the oil filter 96 can be arranged closer to the pump shaft 80 and can be prevented from protruding forward, and therefore the size of the internal combustion engine can be reduced.

The relief passageway 100 is oriented horizontally in the lateral direction in the vicinity of the lower side of the oil passageway. Since the relief valve 101 is attached coaxially, it does not require as much space for the arrangement of the relief passageway 100 and the relief valve 101. This further contributes to the reduction of the size of the internal combustion engine.

The oil introduction path 95 can be extended from any part of the oil passageway 94 oriented horizontally in the lateral direction and can be connected to the oil filter 96. Therefore, the degree of freedom provided for arranging the oil filter 96 in the lateral direction can be increased.

In this embodiment, the exhaust pipe 37 is arranged at the right side of the vehicle body, and the oil filter is arranged offset to the left side of the center of the engine, which is the opposite side of the oil pump 85.

The exhaust pipes 37, extending from the lower surface of the cylinder head 23 in a steeply forward bending position, are arranged parallel to each other between the crank weights on the left and right side in the crankshaft 25, and extend substantially downward (refer to FIG. 7).

As shown in FIG. 7 and FIG. 4, the left side exhaust pipe 37L, which extends from the lower surface of the left side of the cylinder head 23, detours around the oil filter 96 arranged in a protruding condition offset to the left side of the center of the engine. The left side exhaust pipe 37L bends rightward at the same height as its front part, extends rightward along the front surface of the right crankcase 21R, then circles around rearward along the side surface at the lower part of the case cover 28. The left side exhaust pipe 37L then extends rearward along the outer side surface of the case cover 28.

The right side exhaust pipe 37R, which extends from the lower surface on the right side of the cylinder head 23, extends downward in front of the left side exhaust pipe 37L extending rightward on the front surface of the right crankcase 21R. The right side exhaust pipe 37R circles around into an indentation 21R*a* at the lower right comer of the right crankcase 21R, then extends rearward.

As shown in FIG. 7 and FIG. 4, the lowest point of the right side exhaust pipe 37R, which is arranged at a lower position of the left side exhaust pipe 37L, is at substantially the same height as the lowest point of the crankcase 21. Therefore, the exhaust pipe 38 arrangement does not affect the minimum ground clearance of the vehicle body.

The oil filter 96 protruding forward from the lower part on the front surface of the crankcase 21 has a high degree of freedom with respect to arrangement in the lateral direction. Therefore, the two exhaust pipes 37R, 37L, which extend from the cylinder head 23 on the front surface of the crankcase 21, and the oil filter 96, can be arranged closer to each other without overlapping and protruding. Therefore, the size of the vehicle can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubrication structure for an internal combustion engine comprising:

an oil pump provided at a first end of an oil pump shaft, said oil pump shaft arranged in parallel with a crankshaft;

a plurality of oil passageways extending from a side surface of a pump chamber of the oil pump to a second end of the oil pump shaft, said oil passageways arranged in parallel with the oil pump shaft;

an oil filter positioned facing towards the oil passageways; and an oil communicating passageway extending vertically from a first oil passageway to the oil filter, wherein the oil filter protrudes forward from a crankcase of the engine.

2. The lubrication structure according to claim 1, wherein said first and said second ends of the oil pump shaft are arranged radially outward from a crankweight section of the crankshaft.

3. The lubrication structure according to claim 2, wherein the oil filter is arranged in a position offset from a center of the engine on a side of the first oil passageway opposite to the oil pump.

4. The lubrication structure according to claim 3, wherein the first oil passageway and an oil relief passageway are formed in a mutually parallel arrangement, said first oil passageway formed on a first side of an oil discharge path from the oil filter and said oil relief passageway formed on a second side of an oil discharge path.

5. The lubrication structure according to claim 4, wherein a relief valve is provided between the oil filter and the oil pump in a position within the oil relief passageway and coaxial therewith.

6. A lubrication structure for an internal combustion engine, the internal combustion engine including a crankcase divided into a left crankcase and a right crankcase along a longitudinal centerline, and having a crankshaft arranged transversely therein, said lubrication structure comprising:

an oil pump having a pump chamber provided at a first end of an oil pump shaft, said oil pump shaft arranged in parallel with the crankshaft;

a plurality of oil passageways extending from a side surface of the pump chamber of the oil pump to a second end of the oil pump shaft, said oil passageways arranged in parallel with the oil pump shaft;

an oil filter positioned facing towards the oil passageways;

an oil introduction passageway extending vertically from a first oil passageway to the oil filter; and an oil discharge port forming an oil supply passageway from an oil pan positioned in a lower portion of said crankcase.

7. The lubrication structure according to claim 6, wherein said oil introduction passageway and said oil discharge port are formed in said left crankcase and an oil discharge port is formed in said right crankcase.

8. The lubrication structure according to claim 6, wherein the first oil passageway and an oil relief passageway are formed in a mutually parallel arrangement.

9. The lubrication structure according to claim 8, wherein said oil relief passageway is formed in said right crankcase.

10. The lubrication structure according to claim 9, said first oil passageway formed on a first side of an oil discharge path from the oil filter and said oil relief passageway formed on a second side of an oil discharge path.

11. The lubrication structure according to claim 8, wherein a relief valve is provided between the oil filter and the oil pump in a position within the oil relief passageway and coaxial therewith.

12. The lubrication structure according to claim 11, wherein said relief valve is formed in said right crankcase.

13. The lubrication structure according to claim 10, wherein a relief valve is provided between the oil filter and the oil pump in a position within the oil relief passageway and coaxial therewith.

14. The lubrication structure according to claim 13, wherein said relief valve is formed in said right crankcase.

15. The lubrication structure according to claim 14, wherein said relief valve is securedly engaged by a protuberance formed in said right crankcase.

16. The lubrication structure according to claim 15, wherein the oil filter is arranged in a position offset from the longitudinal centerline of the engine on a side of the first oil passageway opposite to the oil pump.

17. The lubrication structure according to claim 16, wherein a chain is provided between a drive sprocket fitted to a right end of a lower side balancer shaft protruding from the right crankcase.

18. The lubrication structure according to claim 17, wherein a driven sprocket is fitted to the first end of the pump drive shaft.

* * * * *